US010151545B1

(12) United States Patent
Hill

(10) Patent No.: US 10,151,545 B1
(45) Date of Patent: Dec. 11, 2018

(54) BI-SONIC GAS BLOCK FOR FIREARMS

(71) Applicant: Brandon Scot Hill, Houston, TX (US)

(72) Inventor: Brandon Scot Hill, Houston, TX (US)

( * ) Notice: Subject to any disclaimer, the term of this patent is extended or adjusted under 35 U.S.C. 154(b) by 72 days.

(21) Appl. No.: 15/491,658

(22) Filed: Apr. 19, 2017

Related U.S. Application Data

(60) Provisional application No. 62/327,404, filed on Apr. 25, 2016.

(51) Int. Cl.
*F41A 5/28* (2006.01)

(52) U.S. Cl.
CPC ..... *F41A 5/28* (2013.01)

(58) Field of Classification Search
CPC ..... F41A 5/28; F41A 5/26; F41A 5/18; F41A 21/28; F41A 15/14
USPC ..... 42/76.01; 89/193, 191.01, 191.02, 192
See application file for complete search history.

(56) References Cited

U.S. PATENT DOCUMENTS 7,461,581 B2 * 12/2008 Leitner-Wise ..... F41A 3/12 89/191.01
7,610,844 B2 * 11/2009 Kuczynko ..... F41A 5/28 89/193
7,739,939 B2 * 6/2010 Adams ..... F41A 5/26 89/191.01
7,856,917 B2 * 12/2010 Noveske ..... F41A 5/28 89/193
7,891,284 B1 * 2/2011 Barrett ..... F41A 5/28 89/14.4
8,161,864 B1 * 4/2012 Vuksanovich ..... F41A 5/26 89/191.01
8,210,089 B2 * 7/2012 Brown ..... F41A 5/18 89/191.02
8,316,756 B1 * 11/2012 Woodell ..... F41A 5/28 89/193
8,607,688 B2 * 12/2013 Cassels ..... F41A 5/28 89/191.01
8,701,543 B2 * 4/2014 Brinkmeyer ..... F41A 21/30 89/191.01
8,863,639 B2 * 10/2014 Gomez ..... F41A 5/18 89/191.01
8,875,614 B2 * 11/2014 Gomez ..... F41A 5/28 89/193
8,960,069 B1 * 2/2015 Soong ..... F41A 5/28 89/193
2014/0060312 A1 * 3/2014 Ruck ..... F41A 5/28 89/193
2014/0075807 A1 * 3/2014 Lewis ..... F41A 15/14 42/25
2014/0076151 A1 * 3/2014 Kramer ..... F41A 5/26 89/193

(Continued)

*Primary Examiner* — Michael David
(74) *Attorney, Agent, or Firm* — Clark Hill Strasburger

(57) ABSTRACT

An apparatus for adapting a firearm for supersonic and subsonic ammunition. The apparatus includes a housing with channels for receiving propellant gas for cycling the firearm and for regulating the pressure of the gas that cycles the firearm. The housing includes a piston in a chamber that constricts the flow of gas when the barrel pressure exceeds a predetermined value. The apparatus includes a spring for applying force to the piston so that the piston position adjusts based on pressure of the gas for each type of ammunition. The method includes steps for manufacturing a firearm to incorporate the apparatus.

3 Claims, 5 Drawing Sheets

(56) References Cited

U.S. PATENT DOCUMENTS

| | | | | |
|---|---|---|---|---|
| 2014/0311332 | A1* | 10/2014 | Carlson | F42B 5/045<br>89/191.01 |
| 2014/0352188 | A1* | 12/2014 | Widder | F42B 5/184<br>42/14 |
| 2015/0292825 | A1* | 10/2015 | Cassels | F41A 5/28<br>89/193 |
| 2016/0161212 | A1* | 6/2016 | Bergeron | F41B 11/68<br>124/73 |
| 2016/0202012 | A1* | 7/2016 | Kokinis | F41A 21/28<br>89/193 |

* cited by examiner

BI-SONIC GAS BLOCK FOR FIREARMS

BACKGROUND OF THE DISCLOSURE

1. Field of the Disclosure

This disclosure relates to the field of firearms, especially gas-operated firearms.

2. Description of the Related Art

Semi-automatic and full automatic firearms use a power source to eject a fired shell casing and/or load the next round in a firing sequence. Going from a spent round to the next one is referred to as "cycling" the weapon. One power source that may be used for cycling a firearm is gas produced during the combustion of propellant in the round. Firearms that use ignited propellant gas for cycling are call gas-operated.

A typical gas-operated weapon has a barrel through which the projectile portion of the round travels after ignition of the propellant. The barrel has a port or opening along its length that allows some of the propellant gasses to be redirected from propelling the projectile to cycling the firearm.

Firearms are configured to fire a specific type of ammunition. The ammunition is generally characterized by caliber, propellant load, propellant type, casing type, and projectile mass. A firearm with a specific barrel diameter will only fire ammunition of a specific caliber; however the same firearm may be able to accommodate a variety of propellant loads, casing types, and projectile masses.

Ammunition may be classified as "subsonic" and "supersonic" based on the propellant load, propellant type, and projectile mass. Generally, subsonic ammunition has a propellant load and propellant type that will impart sufficient energy to a projectile mass so that, when fired, the projectile will exit the barrel at a subsonic speed. Likewise, supersonic ammunition has a propellant load and propellant type that will impart sufficient energy to a projectile mass so that, when fired, the projectile will exit the barrel at supersonic speed.

A consequence of using supersonic ammunition in a suitable firearm is that the projectile will produce a sonic crack when the speed of sound is exceeded. Since the sonic crack is caused by the projectile passing through the air, and not the ignition of the propellant, the sonic crack cannot be suppressed like the report of the firearm. Thus, firearms that are configured for firing supersonic ammunition are not suitable for activities were limiting noise is important.

A shortcoming of current gas-operated firearms is that their cycling mechanisms are designed to operate with either supersonic ammunition or subsonic ammunition, but not both. If subsonic ammunition is used in a firearm designed for supersonic ammunition, there may not be sufficient propellant gas pressure to cycle the firearm, resulting in a weapon jam or forcing the user to manually cycle the firearm. Similarly, if supersonic ammunition is used in a firearm designed for subsonic ammunition, the propellant gas pressure may exceed the parameters of the firearm, resulting in a structural failure that may damage the firearm and/or injure the user.

There is a need for a gas-operated firearm that can fire both supersonic and subsonic ammunition. There is also a need from a method of modifying a standard configuration gas-operated firearm to use supersonic and subsonic ammunition. Further, there is a need for an adapter for a gas-operated firearm that can modify the operation of firearm based whether supersonic or subsonic ammunition is being fired.

BRIEF SUMMARY OF THE DISCLOSURE

In aspects, the present disclosure is related to firearms, especially gas-operated firearms.

One embodiment according to the present disclosure includes an apparatus for regulating gas pressure in a gas-operated firearm, the apparatus comprising: a housing comprising: a first channel; a second channel; a third channel; and a piston chamber, wherein the first channel, the second channel, and the third channel are connected to the piston chamber; a piston disposed in the piston chamber, the piston comprising: a body with a first portion, second portion, and third portion distributed longitudinally, wherein the second portion has a smaller diameter than the first and third portions; and a pin adjacent to the first portion and disposed in the second channel; a spring tube in mechanical communication with the housing and open to the piston chamber; a plug disposed in the spring tube and in mechanical communication with the piston; and a spring disposed in the spring tube and in mechanical communication with the plug, wherein the spring is configured to apply force on the piston to position the second portion in alignment with the first channel and the third channel.

Another embodiment according to the present disclosure includes a system for firing supersonic and subsonic ammunition using the same firearm, the system comprising: a gun barrel, the gun barrel comprising: a tubular with a firing chamber on one end; a gas port disposed along the length of the tubular; a sample port disposed along the length of the tubular between the gas port and the firing chamber; a gas-driven cycling mechanism for loading ammunition in to the firing chamber; a gas tube supplying gas to the gas-driven cycling mechanism; a housing comprising: a first channel aligned with the gas port; a second channel aligned with the sample port; a third channel aligned with the gas tube; and a piston chamber, wherein the first channel, the second channel, and the third channel are connected to the piston chamber; a piston disposed in the piston chamber, the piston comprising: a body with a first portion, second portion, and third portion distributed longitudinally, wherein the second portion has a smaller diameter than the first and third portions; and a pin adjacent to the first portion and disposed in the second channel; a spring tube in mechanical communication with the housing and open to the piston chamber; a plug disposed in the spring tube and in mechanical communication with the piston; and a spring disposed in the spring tube and in mechanical communication with the plug, wherein the spring is configured to apply force on the piston to position the second portion in alignment with the first channel and the third channel.

Another embodiment according to the present disclosure includes a method of regulating cycling pressure in a gas-operated firearm, the apparatus comprising: a housing comprising: a first channel; a second channel; a third channel; and a piston chamber, wherein the first channel, the second channel, and the third channel are connected to the piston chamber; a piston disposed in the piston chamber, the piston comprising: a body with a first portion, second portion, and third portion distributed longitudinally, wherein the second portion has a smaller diameter than the first and third portions; and a pin adjacent to the first portion and disposed in the second channel; a spring tube in mechanical communication with the housing and open to the piston chamber; a plug disposed in the spring tube and in mechanical communication with the piston; and a spring disposed in the spring tube and in mechanical communication with the plug, wherein the spring is configured to apply force on the piston to position the second portion in alignment with the first channel and the third channel; and the method comprising: modifying a flow path cross-section between the first channel and the second channel based on a pressure in the second channel.

Examples of the more important features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

A better understanding of the present disclosure can be obtained with the following detailed descriptions of the various disclosed embodiments in the drawings, which are given by way of illustration only, and thus are not limiting the present disclosure, and wherein.

DETAILED DESCRIPTION OF THE DISCLOSURE

Figure 1:
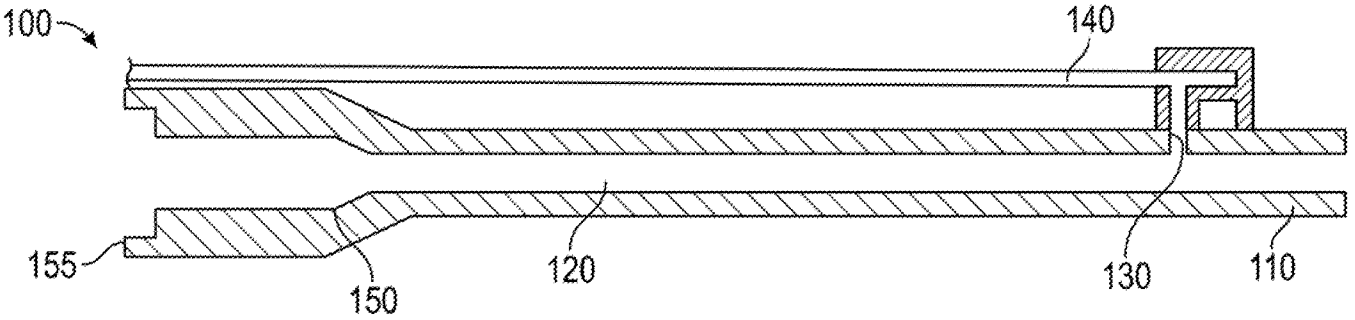
FIG. 1 is a diagram of a typical configuration of a gas return on a gas-operated firearm.

In aspects, the present disclosure is related to firearms. Specifically, the present disclosure is related to adapting a firearm to fire both supersonic and subsonic ammunition. The present invention is susceptible to embodiments of different forms. There are shown in the drawings, and herein will be described in detail, specific embodiments with the understanding that the present invention is to be considered an exemplification of the principles and is not intended to limit the present invention to that illustrated and described herein.

FIG. 1 shows a diagram of a typical gas return system 100 on a gas-operated firearm, such as an M16 rifle. The system 100 includes a gun barrel 110 with an inner bore 120 along its length and is configured as part of a firearm. The barrel 110 includes a gas port 130 on the side of the barrel 110 configured to release propellant gasses when a round is fired. A gas tube 140 is connected to the gas port 130 to provide a pathway for the propellant gases from the gas port 130 to the cycling mechanism (not shown) of the firearm. In a direct impingement type gas-operated firearm, the gas tube 140 is configured to provide a gas path directly to the cycling mechanism from the gas port 130. The barrel 110 includes a chamber 150 at one end that is dimensioned to receive a round. The gas port 130 is usually located between 7.25 and 14 inches from a base 155 of the chamber 150, however the gas port 130 location varies widely depending on the firearm, and it is contemplated that the gas port 130 may be outside of the range of 7.25 to 14 inches from the base 155. The cycling mechanism demands a specific range of pressures from the gas tube 140 in order to operate properly, and the available gas pressure is determined by the propellant load and propellant type of the round, the position of the gas port 130 relative to the chamber 150 and the diameter of the inner bore 120. Since acceptable cycling pressure, the distance between the gas port 130 and the chamber 150 and the diameter of the inner bore 120 are substantially fixed, the type of round (supersonic or subsonic) determines whether the available gas pressure is suitable for the cycling mechanism.

Figure 2:
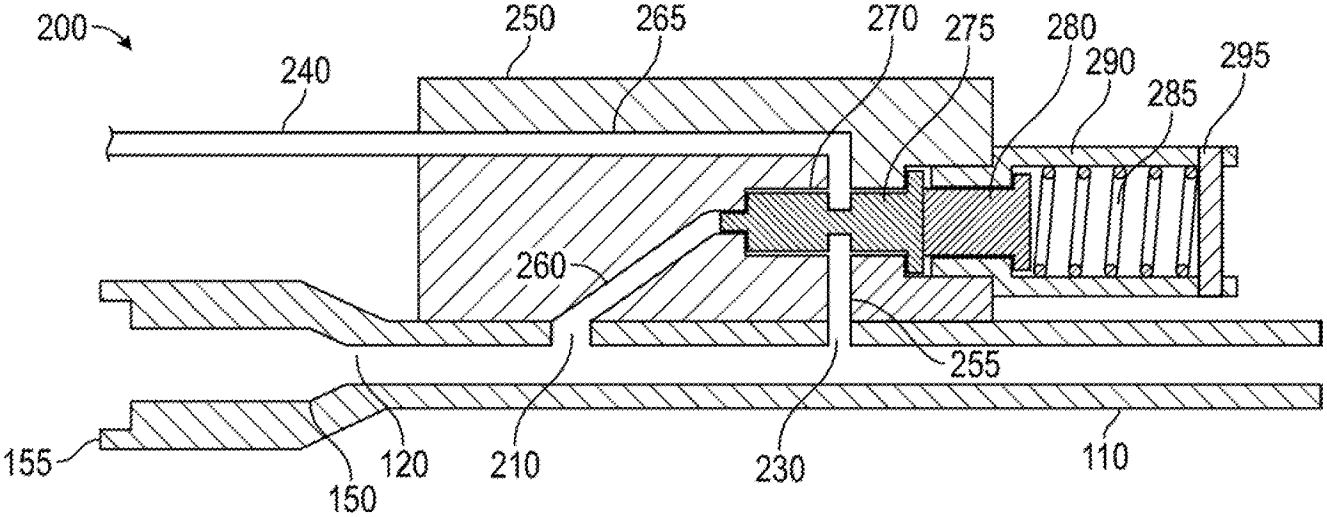
FIG. 2 is diagram of a gas return for gas-operated firearm modified with an adapter to fire supersonic and subsonic ammunition according to one embodiment of the present disclosure.

FIG. 2 shows a side view cutaway diagram of the gas return system 100 modified with an adapter 200 that will allow the both supersonic and subsonic rounds to be fired from the same barrel 110. The barrel 110 may be modified (or originally manufactured) to have a shortened gas port 230 that is substantially closer to the base 155 of the chamber 150 than in FIG. 1. The shortened gas port 230 may be located at a position along the barrel 110 at a distance from the base 155 of the chamber 150 that is less than the distance between the base 155 of the chamber 150 and the gas port 130 in a corresponding weapon. This shortened distance, in a non-limiting example, may be between about 3.75 and 5 inches from the base 155 of the chamber 150, though a person of ordinary skill in the art would understand that this shortened distance may vary based on the gun and the ammunition to be used in the gun.

Since the pressure of propellant gas decreases along the length of the barrel 110 as a projectile from the round travels toward the end of the barrel 110, the shortened gas port 230 sees a higher pressure than the gas port 130 (in FIG. 1) when the same round is used. The shortened distance will be less than the standard distance for a gun configured to fire supersonic rounds such that the pressure in the inner bore 120 at the gas port 230 when a subsonic round is fired will be substantially similar to pressure in the inner bore 120 at the gas port 130 when a supersonic round is fired. This means that the problem of insufficient cycling pressure has been resolved for subsonic ammunition but now higher power propellant loads (supersonic ammunition) will present too high a pressure at the shortened gas port 230 for the cycling mechanism. The barrel 110 may also have a sample gas port 210 located a distance from the shortened gas port 230. The sample gas port 210 is disposed along the barrel 110 between the base 155 and shortened gas port 230.

An adapter 200 may be disposed on the barrel 110 to adjust the pressure that reaches a shortened gas tube 240 to be transferred to the cycling mechanism. The adapter 200 may include a housing 250. The housing 250 may include a first channel 255 aligned with the shortened gas port 230 to receive propellant gas from the barrel 110. The housing 250 may include a second channel 260 aligned with the sample gas port 210 to receive propellant gas from the barrel 110.

The housing 250 may include a third channel 265 aligned with the shortened gas tube 240. The first channel 255, the second channel 260, and the third channel 265 may all converge at a piston chamber 270. The piston chamber 270 holds a piston 275. The piston 275 is configured to block the second channel 260 but to allow at least some of the gas to flow through the piston chamber 270 between the first channel 255 and the third channel 265.

The piston 275 is disposed adjacent to a plug 280 and a spring 285 held by a spring tube 290. While the spring 285 and the plug 280 are shown as separate components, it is contemplated that the spring 285 and the plug 280 may be merged into a single component in some embodiments. The housing 250 includes a cap 295 on the end of the spring tube 290 that secures one end of the spring 285 within the housing 250. The other end of the spring 285 is in mechanical communication with the plug 280. When the piston 275 moves due to the pressure of gas in the second channel 260, force is exerted on the plug 280 and to the spring 285. Since the spring 285 is held in place by the cap 295, the spring 285 provides a countering force to resist the movement of the piston 275. Thus, the spring 285 may be selected to control the degree of movement of the piston 275 when propellant gas applies pressure to the piston 275 through the second channel 260.

Figure 3:
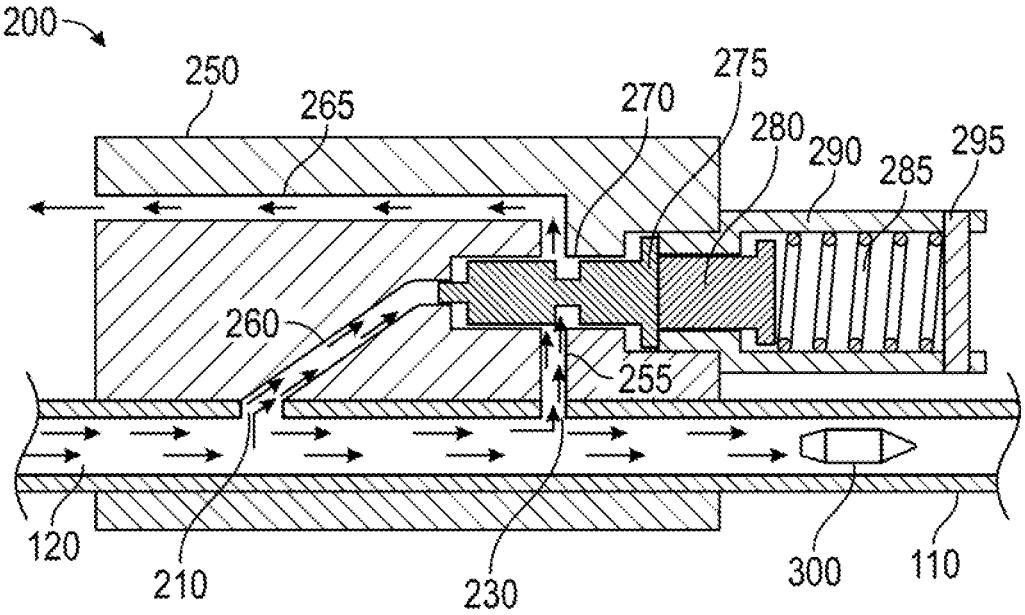
FIG. 3 is a diagram of the operation of the gas return and adapter of FIG. 2 when supersonic ammunition is being used.

FIG. 3 shows a side view of the adapter 200 in operation for a supersonic round. When the supersonic round is fired, the projectile 300 moves through the inner bore 120 and moves past the sample gas port 210. Pressure in the inner bore 120 is transmitted through the second channel 260 to the piston 275 causing the piston 275 move until the spring 285 supplies sufficient force to stop the motion of the piston 275. The piston 275 has sufficient space within the piston chamber 270 to move and is shaped to constrict the flow path between the first channel 255 and the third channel 265. The projectile 300 continues along the barrel 110 and passes the shortened gas port 230. Gas pressure from the inner bore 120 behind the projectile 300 is communicated through the first channel 255 to the constricted path in the piston chamber 270 and into the third channel 265 and the shortened gas tube 240. The constricted path reduces the pressure transmitted to the gas tube 240 down from a higher pressure at the shortened gas port 230 to a lower pressure associated with a subsonic round in the gas tube 240 to be transmitted to the cycling mechanism. In one non-limiting embodiment, the gas pressure from the firing of a supersonic round may be around 28000 psi at the shortened gas port 230 and be reduced by the constriction of the path to about 20000 psi due to the movement of the piston 270 so that the cycling mechanism is not damaged. It is contemplated that the pressures at the shortened gas port 230 and the gas tube 240 may vary widely based on the types of rounds fired and the types of firearms used, and, as such, a person of ordinary skill in the art would understand, with the benefit of the present disclosure, how to position the shortened gas port 230 and the sample port gas 210 for safe operation of the cycling mechanism when adapting or manufacturing the firearm for firing supersonic and subsonic rounds.

Figure 4:
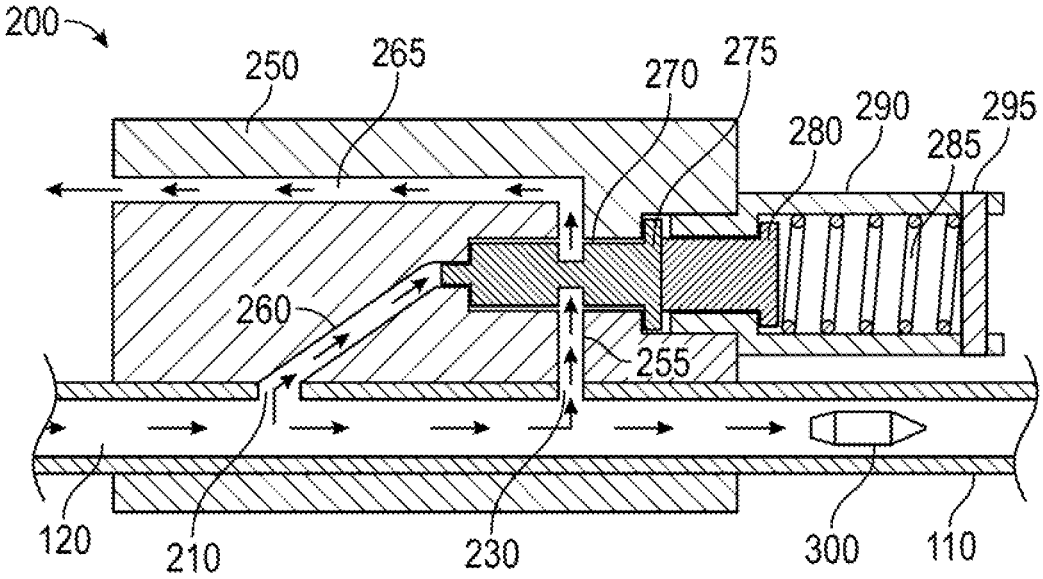
FIG. 4 is a diagram of the gas return and adapter of FIG. 2 when subsonic ammunition is being used.

FIG. 4 shows a side view of the adapter 200 in operation for a subsonic round. When the subsonic round is fired, the projectile 300 moves through the inner bore 120 and passes the sample gas port 210. Pressure in the inner bore 120 is transmitted through the second channel 260 to the piston 275 but is insufficient to cause the piston 275 move due to the force supplied by the spring 285. The flow path between the first channel 255 and the third channel 265 is not constricted. The projectile 300 continues along the barrel 110 and passes the shortened gas port 230. Gas pressure from the inner bore 120 behind the projectile 300 is communicated through the first channel 255 to the flow path in the piston chamber 270 and into the third channel 265 and the shortened gas tube 240. The unconstricted flow path transmits the gas pressure to the shortened gas tube 240 at a pressure sufficient to operate the cycling mechanism (minimum cycling pressure) but low enough to avoid damage to the cycling mechanism (maximum cycling pressure). In one non-limiting example, the gas pressure to the shortened gas tube 240 may be around 20000 psi. A person of ordinary skill in the art would understand that minimum and maximum cycling pressures may vary widely between firearm designs, and that is its contemplated for the gas pressure in the shortened gas tube 240 to be maintained in the range between the maximum and minimum cycling pressure of the cycling mechanism for the particular firearm when supersonic and subsonic ammunition are fired in the firearm. In some embodiments, the piston 275 may move due to the pressure in the inner bore 120 during the firing of a subsonic round, but the movement is not sufficient to move the piston 275 far enough for the flow path between the first channel 255 and the third channel 265 to become constricted.

Figure 5A:
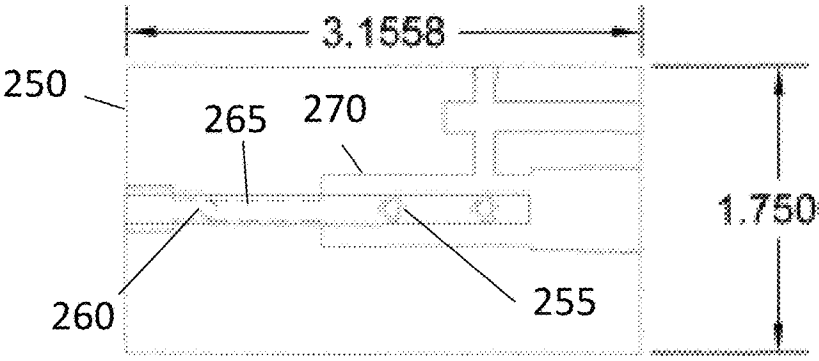
FIG. 5A is a top view of the adapter surrounding a cylindrical tube according to one embodiment of the present disclosure.
Figure 5B:
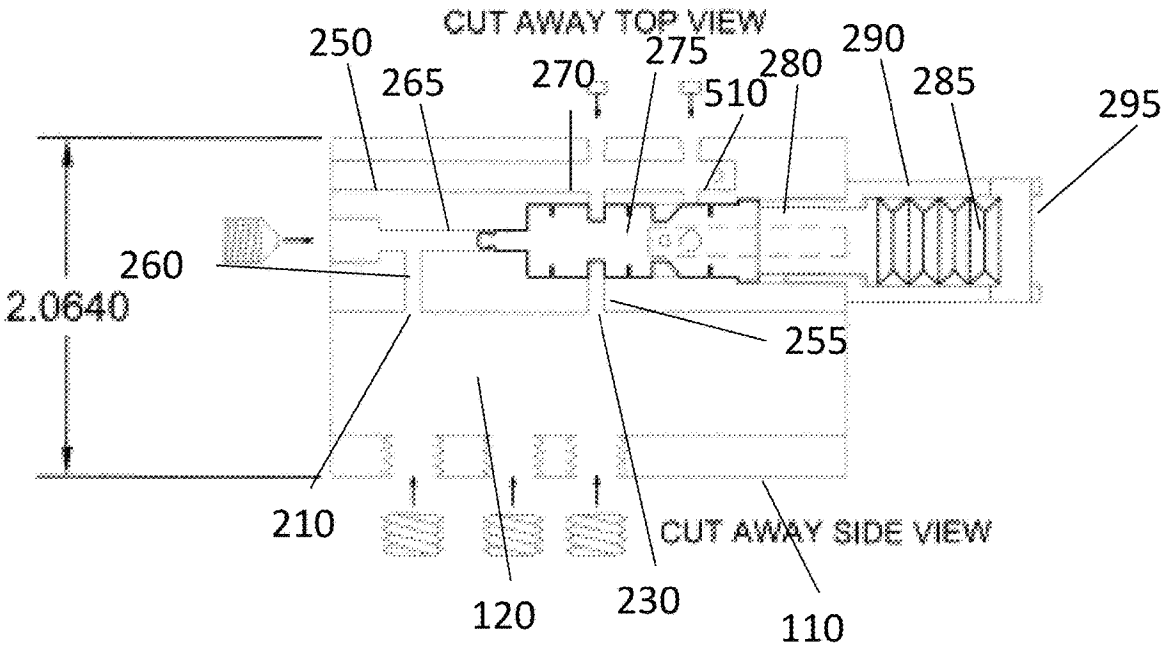
FIG. 5B is a side view of the adapter disposed on a firearm according to one embodiment of the present disclosure.

FIGS. 5A and 5B show a top and side cutaway view of the adapter 200. FIG. 5A is a top view of the adapter 200 showing the housing 250 with internal channels and ports, including the first channel 255, the second channel 260, the third channel 265, the piston chamber 270. FIG. 5B shows the side cutaway view of the adapter 200 with the piston 275 in the piston chamber 270. The spring tube 290 with the cap 295 is shown inserted into the housing 250 with the spring 285 within the spring tube 290 and secured by the cap 295. Also shown is an auxiliary gas channel 510 that can be used as an alternative to the first channel 255.

Figure 6:
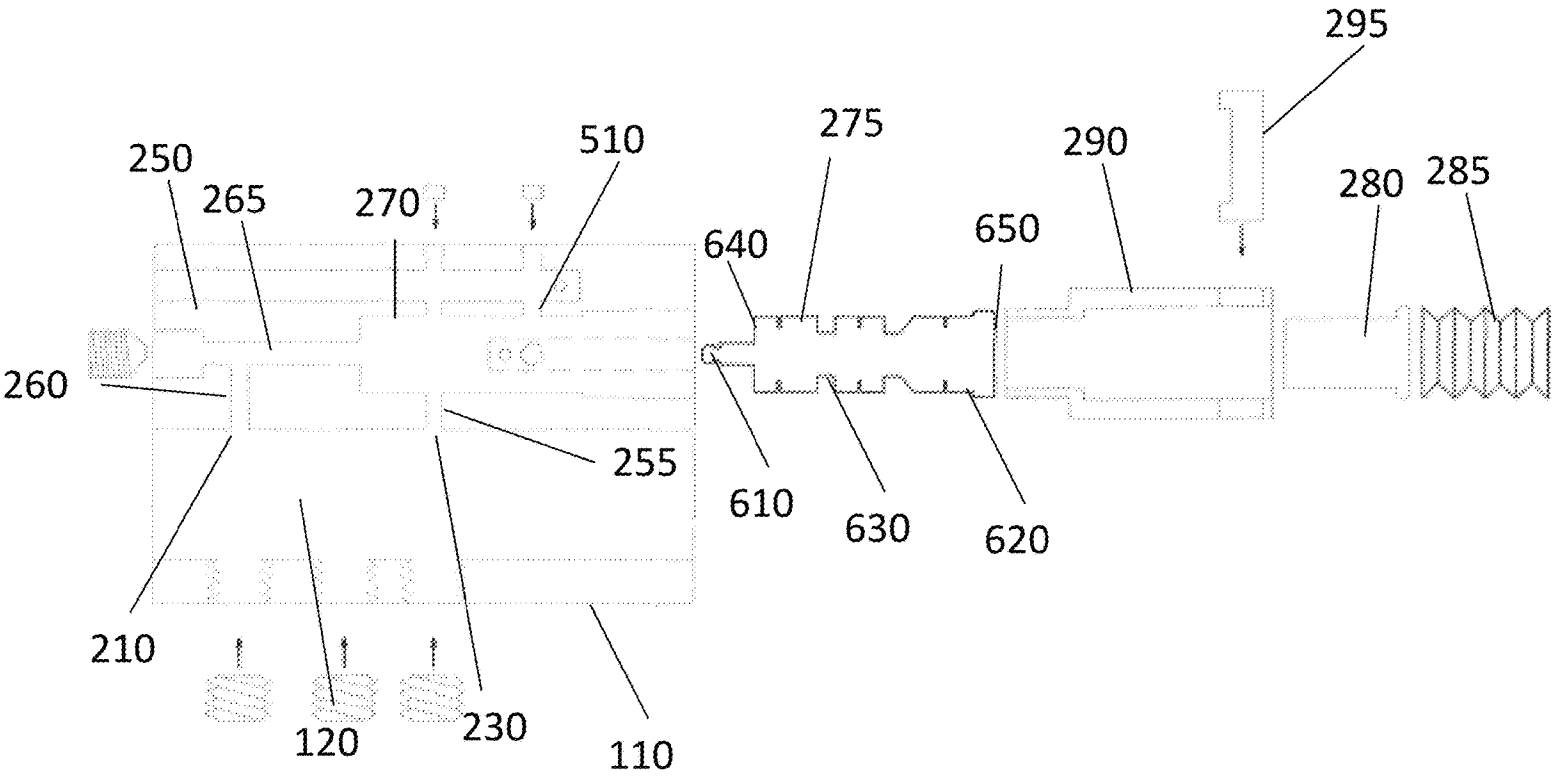
FIG. 6 is an exploded side view of the adapter to one embodiment of the present disclosure.

FIG. 6 shows an exploded view of the adapter 200. The housing 250 and the piston 275 may be made of the same or different materials. The piston 275 may be made of one or more of, but is not limited to, titanium, steel, and aluminum. The piston 275 includes a pin 610 configured to be inserted in the second channel 260 to block the passage of propellant gas from flowing into the piston chamber 270. The piston 275 is dimensioned to substantially fill piston chamber 270 such that the piston 275 only has freedom of motion along one axis. In some embodiments, the piston 275 includes a body 620 with a smaller diameter portion 630 between the ends 640, 650 of the body 620. The body 620 may be, but is not limited to being, cylindrical, rectangular, or a flattened rectangle in shape. In other embodiments, the piston 275 may include additional smaller diameter portions between the ends 640, 650. The piston 275 may be positioned in the piston chamber 270 such that the smaller diameter portion is aligned with the openings of the first channel 255 and the third channel 265.

Figure 7C:
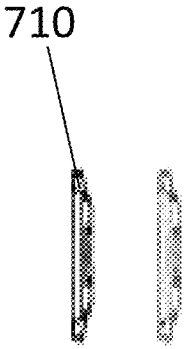
FIG. 7C is a side view of two stackable spring washers for the spring.
Figure 7A:
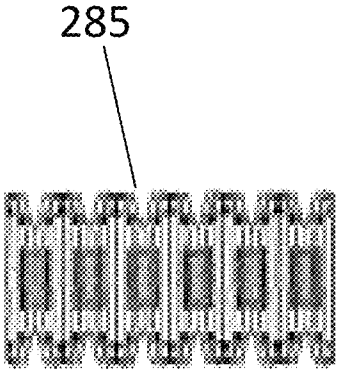
FIG. 7A is a diagram of spring for use in the adapter of FIG. 2 according to one embodiment of the disclosure.
Figure 7B:
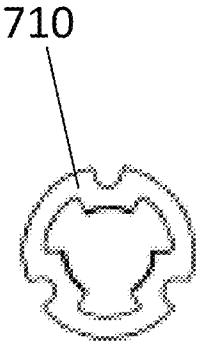
FIG. 7B is a top view of a spring washer for the spring.

FIGS. 7A-7C shows a close up of one embodiment of the spring 285. The spring 285 may include a plurality of spring washers 710 dimensioned to stack within the spring tube 290. In one non-limiting embodiment, the spring washers 710 may be flat disc spring washers, such as model BC0500-026-S Clover®Dome Spring Washers, manufactured by Associated Spring RAYMOND, of Palatine, Ill. The spring washers 710 may be stacked in series, parallel, or a combination of both to obtain a specified spring force sufficient to counter the force on the piston 275 when subsonic rounds are fired but not to prevent constriction of the flow pat when supersonic rounds are fired.

While embodiments in the present disclosure have been described in some detail, according to the preferred embodiments illustrated above, it is not meant to be limiting to modifications such as would be obvious to those skilled in the art.

The foregoing disclosure and description of the disclosure are illustrative and explanatory thereof, and various changes in the details of the illustrated apparatus and system, and the construction and the method of operation may be made without departing from the spirit of the disclosure.

What is claimed is:

1. An apparatus for regulating gas pressure in a gas-operated firearm, the apparatus comprising:

a housing comprising:

a first channel;

a second channel;

a third channel; and a piston chamber, wherein the first channel, the second channel, and the third channel are connected to the piston chamber;

a piston disposed in the piston chamber, the piston comprising:

a body with a first portion, second portion, and third portion distributed longitudinally, wherein the second portion has a smaller diameter than the first and third portions; and a pin adjacent to the first portion and disposed in the second channel;

a spring tube in mechanical communication with the housing and open to the piston chamber;

a plug disposed in the spring tube and in mechanical communication with the piston; and a spring disposed in the spring tube and in mechanical communication with the plug, wherein the spring is configured to apply force on the piston to position the second portion in alignment with the first channel and the third channel.

2. A system for firing supersonic and subsonic ammunition using the same firearm, the system comprising:

a gun barrel with a firing chamber on one end;

a gas port disposed along the length of the gun barrel;

a sample port disposed along the length of the gun barrel between the gas port and the firing chamber;

a gas-driven cycling mechanism for loading ammunition into the firing chamber;

a gas tube supplying gas to the gas-driven cycling mechanism;

a housing comprising:

a first channel aligned with the gas port;

a second channel aligned with the sample port;

a third channel aligned with the gas tube; and a piston chamber, wherein the first channel, the second channel, and the third channel are connected to the piston chamber;

a piston disposed in the piston chamber, the piston comprising:

a body with a first portion, second portion, and third portion distributed longitudinally, wherein the second portion has a smaller diameter than the first and third portions; and a pin adjacent to the first portion and disposed in the second channel;

a spring tube in mechanical communication with the housing and open to the piston chamber;

a plug disposed in the spring tube and in mechanical communication with the piston; and a spring disposed in the spring tube and in mechanical communication with the plug, wherein the spring is configured to apply force on the piston to position the second portion in alignment with the first channel and the third channel.

3. A method of regulating cycling pressure in a gas-operated firearm, the method comprising:

providing an apparatus, the apparatus comprising:

a housing comprising:

a first channel;

a second channel;

a third channel; and a piston chamber, wherein the first channel, the second channel, and the third channel are connected to the piston chamber;

a piston disposed in the piston chamber, the piston comprising:

a body with a first portion, second portion, and third portion distributed longitudinally, wherein the second portion has a smaller diameter than the first and third portions; and a pin adjacent to the first portion and disposed in the second channel;

a spring tube in mechanical communication with the housing and open to the piston chamber;

a plug disposed in the spring tube and in mechanical communication with the piston; and a spring disposed in the spring tube and in mechanical communication with the plug, wherein the spring is configured to apply force on the piston to position the second portion in alignment with the first channel and the third channel; and modifying a flow path cross-section between the first channel and the second channel based on a pressure in the second channel.

* * * * *